United States Patent [19]

Monteleone

[11] 4,329,904

[45] May 18, 1982

[54] TWO-SPEED TUNING MACHINE FOR MUSICAL INSTRUMENTS

[76] Inventor: John Monteleone, 365 Smith Ave., Islip, N.Y. 11751

[21] Appl. No.: 150,308

[22] Filed: May 16, 1980

[51] Int. Cl.[3] ..... G10D 3/14

[52] U.S. Cl. ..... 84/306

[58] Field of Search ..... 84/200, 206, 304–306

[56] References Cited

U.S. PATENT DOCUMENTS

| | | | |
|---|---|---|---|
| 155,352 | 9/1874 | White | 84/306 |
| 1,561,566 | 11/1925 | Purdy | 84/306 |
| 4,151,778 | 5/1979 | Beattie et al. | 84/306 |
| 4,191,086 | 3/1980 | Spercel | 84/306 |

*Primary Examiner*—Lawrence R. Franklin
*Attorney, Agent, or Firm*—Daniel M. Schaeffer

[57] ABSTRACT

A two-speed tuning machine for mounting on a hand-held, stringed, musical instrument has a first, relatively fast, gearing for rotating a post upon which a string is reeled during initial tensioning to a rough approximation of the desired final pitch, and a second, relatively slow, gearing, with its own separate input shaft, for rotating the same post during the final, precision tensioning to final pitch. A planetary-gear train having a relatively low gear-reduction ratio is used during the initial tensioning by applying manual rotation to an input shaft attached to the sun gear of the planetary-gear train, the planet gears being gang-coupled to rotate the post. The ring gear of the planetary-gear train is restrained during the initial tensioning by means of a worm engaging a worm ring on the periphery of the ring gear. The worm is rotated by manual rotation applied to the second separate input shaft to cause the entire planetary-gear train to rotate at a relatively high gear-reduction ratio during the final, precision tensioning.

10 Claims, 4 Drawing Figures

FIG. 1
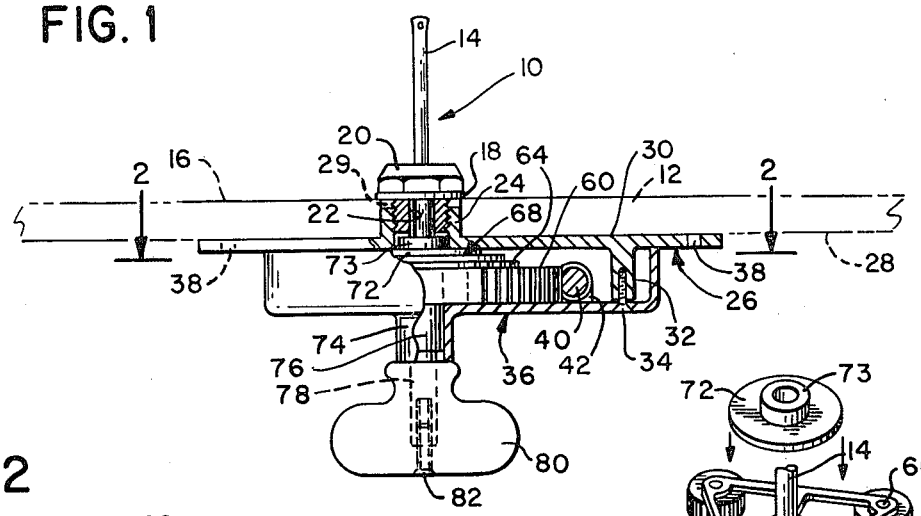
FIG. 2
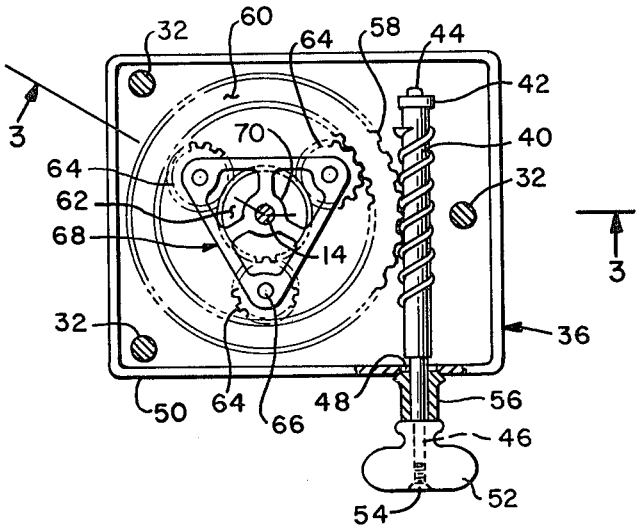
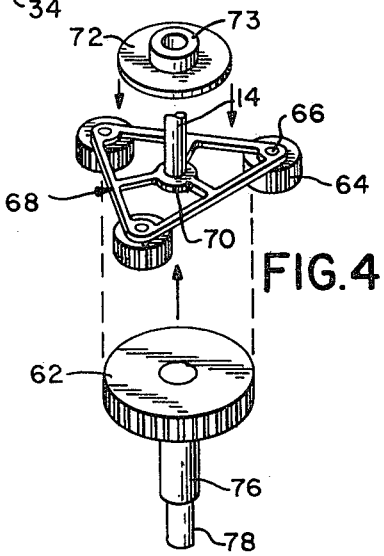
FIG. 4
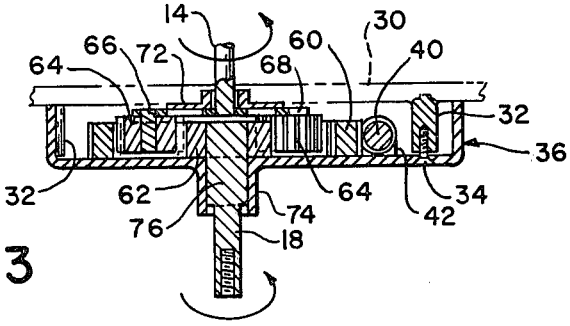
FIG. 3

TWO-SPEED TUNING MACHINE FOR MUSICAL INSTRUMENTS

BACKGROUND OF THE INVENTION

Hand-held, stringed-instruments for the production of music have developed over the centuries almost entirely without the benefit of scientific contributions of the type that has accompanied the development of other musical instruments. According to certain authorities, the most primitive forms of our modern stringed-instruments were those wherein the strings were set into vibration and sound was produced by twanging the strings by means of the fingers. Supposedly, the starting point in the development of this type of musical instrument was the perception of the feeble note given out by the tense string of the hunter's bow. In time, men learned how to increase the volume of the sound by stretching the string over a soundboard, and, at a much later date, how to obtain numerous sounds from a single string by stopping the strings. Finally, the earliest prototypes of the modern guitar and the lute were created when it was discovered that the quality of the tone was enhanced when a sound hole was provided in an enclosed airspace associated with the soundboard.

Thus, since about the 10th century of our era, the evolution of hand-held, stringed musical instruments was essentially completed and these instruments all comprise a resonant box, with or without a sound hole, over which strings of different thickness are stretched across a bridge that stands on the box in such a way that the tension of the strings can be adjusted by means of revolving pegs to which the strings are severally attached at one end, the other end of each string being firmly anchored. To produce the notes of a scale, once each string has been tuned as an open note of an appropriate key, the length of a selected string is selectively varied by "stopping" or pressing the string with the fingers down against a fret to shorten the string length, and, consequently, to produce a different vibrational frequency when the string is caused to vibrate, as by the action of a plectrum, a pick and the like. The fundamental ideas needed to explain the "stopping" of strings have been well know since the time when Greek mathematicians, some thirteen-hundred years earlier, had first correlated the notes emitted by a stringed instrument with the length or tension of the strings.

At a much later date, again through the use of mathematics, it was shown that a better quality of sound will be perceived when a string is plucked near one end because all harmonics are present instead of only the even harmonics which result when a string is plucked at its middle.

In recent years, although there has been no major change in the traditional size or shape of the stringed instruments, which, generally, are still hand crafted on an individual basis by skilled luthiers who continue to utilize traditional fabrication methods and materials of construction, there have been a few significant changes to modern materials after the clear advantages of the modern materials were demonstrated. As an example of change, we find that strings of vegetable or animal origin have been displaced by strings of synthetic fiber or metal. When metal strings, which are used at a greater string tension, were adopted, it was found that the simple frictional tuning peg could no longer be relied upon to maintain tension during playing. Of necessity, the frictional peg had to be replaced by a more reliable device, a geared tuning machine, capable of maintaining the requisite tension.

Most modern, hand-held stringed instruments provide a tuning machine for each string. The tuning machine, located at the head end of a fretboard, is used to tension the string during tuning to pitch as well as to maintain the tension without change during play. On occasion, during play, when it is desired to change the key, the tuning machine is used to change pitch. Two major types of geared tuning machines have come into general use. The tuning machine commonly associated with the banjo comprises a planetary-gear drive, whereas, the guitar generally has some form of a worm-gear tuning machine.

The planetary-gear tuning machine, as used with the banjo, generally has about a four-to-one gear-reduction ratio. That is to say, it requires about four complete manually-initiated complete rotations of an input shaft to result in one rotation of an output shaft. The gear-reduction ratio of the worm-gear tuning machine is generally much greater, on the order of fourteen-to-one. Because the gearing in both types of tuning machine has an inherently high mechanical advantage, either type of tuning machine is equally capable of reliably maintaining a string in tune at a selected tension during the playing of an instrument.

Despite the fact that the planetary-gear tuning machine and the worm-gear tuning machine can be considered as equivalents when maintaining tension is the criterion, the two tuning machines are not equivalents when the consideration is the relative speed of restringing and tuning the string to pitch. There are occasions when it may be considered necessary to restring in as short a time as possible. At other times, speed is not considered important. Often, the precision of the desired pitch is considered to have more value than the time required to arrive at the desired pitch. Those skilled in the art will appreciate that the prior art tuning machines offer less than optimal performance. Much greater time is needed to initially tension a string during restringing when the instrument uses a worm-gear drive, which requires about fourteen complete revolutions of an input shaft to generate one complete revolution of its output shaft, than when the instrument uses a planetary-gear drive tuning machine with four-to-one gear ratio. Much less time is wasted in trial-and-error adjustments for excessive overshoot during the precision tensioning to precise pitch after initial tensioning to approximate pitch when a tuning machine has a high gear-reduction ratio.

Therefore, what is needed to obviate the inordinately long time required to take up the slack with the guitar-type tuning machine, and to permit rapid final precision tuning to pitch without wasting time in trial-and-error adjustments of a gross nature, as with a banjo-type tuning machine, is a two-speed tuning machine that combines all of the advantages of both types of existing tuning machines without any of their disadvantages. What is needed is a tuning machine having a relatively low gear-reduction ratio for use during the initial, rapid approach to the approximate desired pitch, and a second, relatively high reduction-ratio drive for use during the final, precise setting of the desired pitch. Further, a tuning machine having a selective two-speed drive of the type desired should be inexpensive to make and must be compatible with existing stringed instruments without need for new, novel or unusual mounting methods.

SUMMARY OF THE INVENTION

The above described and other deficiencies of the prior art tuning machines are remedied by my new and novel tuning machine which has two, separate, selectively-operable, manually-rotational input shafts. Each shaft is coupled to selectively rotationally drive the same output shaft by means of appropriate reducing-gear drive mechanisms. The output shaft includes means for threadably engaging a string and for reeling the string during tensioning. When the two-speed tuning machine of my invention is used to take up the slack and to initially tension a string following restringing and the like, the input shaft driving the relatively low reduction-ratio gearing is selectively manipulated manually until an initial tension and a rough first approach to the desired pitch are achieved without trial-and-error. At this stage, with no change to the tuning machine, the input shaft driving the relatively high reduction-ratio gearing is selectively manipulated manually until a final, precise tuning to pitch has been obtained.

In accordance with the teaching of my invention, I provide a planetary-gear drive means as the relatively low reduction-ratio gearing. The input shaft of the planetary-gear drive is directly coupled to rotate the sun gear, and the plurality of planet gears are gang coupled to rotate the output shaft. With this arrangement, whenever the ring gear of the planetary-gear drive is constrained from rotation, an angular rotation of the input shaft is translated to the output shaft as an angular rotation of reduced angular arc by virtue of the angular movement of the planet gears around the sun gear in their orbital path. Additionally, I provide a means for selectively immobilizing the ring gear, and, alternatively, for selectively rotating the ring gear by means of a second, manually-rotational input shaft coupled to the ring gear through an appropriate relatively high reduction-ratio gearing. Thus, the ring gear and the entire planetary-gear drive, including its output shaft, is rotated by the action of the second input shaft as a unit, at a relatively high gear-reduction ratio when the second input shaft is manually rotated. The relatively high reduction-ratio gear arrangement coupling the second shaft to the ring gear restrains the ring gear during manipulation of the first input shaft.

In a presently preferred embodiment of my invention, the relatively high reduction-ratio gearing coupling to the ring gear comprises a second manually-rotational input shaft which supports a worm near one end, the worm being engaged with a worm ring mounted on the outer periphery of the ring gear. The selected gear-reduction ratio of this worm-gear drive is high enough to immobilize the ring gear while the input shaft of the planetary gear is rotationally manipulated.

A more complete and better understanding of the practice of my invention and of the construction and use of a presently preferred embodiment of my two-speed tuning machine can be had by reference to the appended drawing when taken together with the description of the preferred embodiment.

BRIEF DESCRIPTION OF THE DRAWING

FIG. 1 is a partially broken-away, partially sectional elevation of a presently preferred embodiment of the two-speed tuning machine of my invention;

FIG. 2 is a sectional plan view of the tuning machine of FIG. 1 along view lines 2—2 of FIG. 1;

FIG. 3 is a sectional view of the same tuning machine along view lines 3—3 of FIG. 2; and FIG. 4 is an enlarged, exploded perspective view illustrating the method of assembly of the sun gear and the planet gears of the planetary-gear drive of my two-speed tuning machine.

DESCRIPTION OF THE PREFERRED EMBODIMENT

Referring now to the figures of the drawing, wherein like reference symbols refer to like elements of the invention, a presently preferred embodiment of my two-speed tuning machine, generally designated as 10, is shown in FIG. 1 in position for final fastening upon a peghead 12, shown in phantom, of a stringed musical instrument. Reel post 14, which has an eye for threadably engaging a string preparatory to reeling the string thereon for tensioning the string during tuning, is shown generally perpendicular to and extending above the upper plane surface 16 of peghead 12, to which tuning machine 10 is shown partially fastened, with washer 18 urgedly compressed into contact with upper surface 16 by head bolt 20. Head bolt 20, which has a hex head adapted to being tightened by means of a conventional open end wrench and the like, a threaded shank with male screw threads along its entire length, and an axial cylindrical through bore 22 sized for a sliding fit with reel post 14, is adapted to function as an outboard bearing of extended surface for reel post 14. The male screw threads of head bolt 20 engage in rotational fastening engagement with complementary female screw threads in nozzle 24 of base 26, shown in flush contact with the lower surface 28 of peghead 12. Nozzle 24 penetrates into but does not extend through the entire depth of opening 29 provided in peghead 12 for the location and mounting of tuning machine 10.

Base 26 is an extended plate 30 with nozzle 24 rising perpendicularly from one surface and a plurality of screw-receiving boss members 32 depending from the opposite surface, each boss member 32 having an axial recess adapted to receiving the threaded shank portion of a flat head screw, not shown, which extends through a corresponding one of a plurality of screw holes 34 in housing 36 when housing 36 and base 26 are matedly joined together to form a sealed enclosure for the gearing in tuning machine 10. Base 26 also includes a plurality of suitably positioned mounting holes 38 which permit the passage of a threaded shank of a mounting screw, not shown, for the final attachment of base 26 to peghead 12.

Worm 40, mounted within housing 36, is rotationally supported at one end by journal box 42 adapted to receive the inboard end 44 of the shaft of worm 40. The outboard end 46 of the shaft of worm 40 is shown extending through a suitably sized aperture 48 in sidewall 50 of housing 36, which aperture permits the insertion of worm 40 during assembly and functions also as an outboard bearing-support. Worm 40 can be made to rotate around the axis of its shaft in either direction by the manual application of a turning torque using tuning button 52. Tuning button 52 is fastened to the outboard end 46 of the shaft of worm 40, as is well known in the art, in a selectively variable friction assembly which can be adjusted as desired by selectively tightening screw 54 to vary the compression upon the contacting surfaces of tuning button 52 and outboard bearing 56 and, thereby, changing the amount of resistance perceived when worm 40 is manually rotated by means of tuning button 52. Outboard bearing 56, shown in cross section, is located on the outboard end 46 of the shaft of worm 40 intermediate sidewall 50 and tuning button 52 with one end supported in aperture 48.

The threads on worm 40 are engaged in rotational driving relationship with gear teeth of worm ring 58 shown integral with and on the outer periphery of a ring gear 60 of a planetary-gear drive mechanism. The planetary-gear drive, as is well known in the art, comprises a ring gear 60, a sun gear 62, and a plurality of planet gears 64. Each planet gear 64, as is shown with greater clarity in FIG. 4, is a spur gear mounted to spin on its own shaft 66, with each shaft 66 fixedly attached to spider assembly 68. Sun gear 62 is also a spur gear with its gear teeth meshed in driving relationship with the teeth of each of the planet gears 64. Spider assembly 68 comprises a central hub 70, fixedly attached to and axially aligned with reel post 14 and a framework for fixedly supporting each shaft 66 in a load transmitting relationship in a uniformly spaced-apart configuration.

Hat-shaped bushing 72, which functions as an inboard bearing for reel post 14, has a centrally located annular crown portion 73 adapted to snug fit inside nozzle 24. Bushing 72 is positioned on reel post 14 with the upper extended surface of its brim portion in contact with the lower surface of extended plate 30 and with the lower extended surface of its brim portion contacting the hub portion of spider assembly 68. As indicated by the directional arrows in FIG. 4, when the component elements have been brought together, with sun gear 62 meshed with the plurality of planet gears 64 and with bushing 72 on reel post 14, this assemblage can be handled as a unit and inserted into housing 36 in meshed relationship with ring gear 60 which has previously been engaged with worm ring 58 meshed with worm 40. Housing 36 has a depending nozzle 74 with an axial bore adapted to slip fit with shaft 76 of sun gear 62.

Finally, after all gears are properly meshed, base 26 and housing 36 can be mated and fastened together by flat head screws as described above with reel post 14 extending beyond head bolt 20 and with shaft extension 78 of input shaft 76 extending beyond nozzle 74. Shaft extension 78 has a reduced diameter adapted to receive a tuning button 80 which is fastened thereon with a tightening screw 82 so that tuning button 80 can be selectively compressed against the adjoining surface of nozzle 74 to vary the friction for the same purpose and in same manner as tuning button 52 is compressed against outboard bearing 56 by the action of tightening screw 54.

Having described the component elements of the tuning machine by my invention and the manner of their assembly, the functional operation of this preferred embodiment of my invention as well as the operational practice of my invention in its broader aspects can now be understood better by reference to FIG. 2 when taken together with FIG. 3. A simplified description of the relatively high speed, or relatively low gear-ratio drive, mode of operation of the illustrated embodiment that is presently preferred may be had by referring first to FIG. 3 wherein the relatively rapid reeling of a string on reel post 14 is accomplished by manual application of a rotation to shaft 76 in the direction indicated by the curved arrow drawn immediately below shaft extension 78. This direction of rotation corresponds to a rotation in the counter-clockwise sense in the view of FIG. 2. Because of the meshing of the sun gear 62 with the plurality of planet gears 64, the direction of the rotation of each of the planet gears 64 is clockwise on its own shaft. However, because ring gear 60 cannot rotate, being immobilized by the engagement of its integral worm ring 58 with worm 40, the rotation of the plurality of planet gears causes spider assembly 68 with attached reel post 14 to rotate in the direction of the uppermost curved directional arrow in FIG. 3, a direction corresponding to a rotation in the counter-clockwise sense as viewed in FIG. 2. The gear ratio for the worm gearing is selected to provide a mechanical advantage sufficient to facilitate the rotation under load of worm ring 58 when worm 40 is manually driven, and to prevent any rotation of worm ring 58 when torque is applied to worm ring 58 by way of planet gears 64 and ring gear 60.

As is well known in the art, by an appropriate selection of the relationship of the relative size-ratio between the meshing gears it is possible to design a planetary-gear drive unit to have any specifically selected ratio of input to output within a relatively broad range of reduction ratios, which reduction ratios all have a mechanical advantage that is sufficient not only to assure smooth manual manipulation but is also sufficient to guarantee that a tensioned string will be held at tension securely and will not detension because of forced rotation of the gears. As an example, by appropriate selection of the parameters one can provide a 4:1 reduction ratio whereby four rotations of input shaft 76 generate only one rotation of reel post 14, and, after tensioning of a string, reel post 14 sustains the torque applied by the string without rotation.

The illustrated embodiment of my invention is used in the relatively low speed, or relatively high gear-ratio drive, mode of operation during precise final tuning of a string. In this second mode of operation, turning force is applied to input shaft 46 via tuning button 52 to rotate worm 40 and its enmeshed worm ring 58. Worm ring 58 rotates at a rate relative to worm 40 which is a predetermined fraction of the rate of rotation of worm 40 as a consequence of the preselected gear-reduction ratio. As an example, since a worm-gear drive can be designed for a wide range of speed reductions in a range several-fold the speed reduction obtained with a planetary-gear drive, a suitable reduction ratio for the worm-gear drive of the embodiment illustrated would be 20:1; that is, twenty complete revolutions of worm 40 result in one complete revolution of worm ring 58. In accord with this example, therefore, since one revolution of worm ring 58 around its axis means one revolution of ring gear 60, and since the spider assembly 68 with its planet gears 64 and its reel post 14 is constrained by sun gear 62 from any rotational motion relative to ring gear 60 or to sun gear 62, because of the mechanical advantage inherent in the planet-gear drive, twenty revolutions of worm 40 will result in one revolution of reel post 14.

It will be appreciated by those skilled in the art, in the light of my teaching, that the total time required for restringing and tuning a stringed musical instrument using the first mode of operation followed by the second mode of operation with the two-speed tuning machine of my invention is significantly less than the time required for a corresponding restringing and tuning using any of the tuning machines in the prior art. During the preliminary take-up of slack and pretensioning of a string to obtain a rough approximation of pitch during restringing, I employ the relatively fast, first mode, above described, manually rotating tuning button 80 in only one direction to obtain a rough approximation of string tune without any further bracketing adjustment. Then, for the final, precise, tuning, I employ the second, or relatively slow mode, to drive reel post 14 by manually turning tuning button 52, as required, to quickly arrive at the desired final tuning without gross bracketing adjustments of the string tension. It is obvious that a final tuning of a string, using a tuning machine operating at a speed on the order of my first mode of operation, will require a repetitive, successive series of relatively gross bracketing adjustments of string tension in an effort to obtain a precise tuning after the initial pretensioning of the string to a rough, approximate tuning. It is likewise obvious that the tuning of a string using a tuning machine operating at a speed on the order of my second mode of operation will require an inordinately long time merely to take up the initial slack and thus be ready to essay final tuning. In essence, then, the two-speed tuning machine of my invention, as disclosed herein, combines the best features of the tuning machines of the existing art, and, in a new and novel combination, provides a useful tuning machine which has both a first gear means for relatively rapid initial tensioning of a string and a second relatively high reduction-ratio gear means for precision final tensioning to tune the string to pitch.

It will be obvious to those skilled in the art, in the light of my teaching, that I have provided an inexpensive, reliable, rugged two-speed tuning machine which can be fabricated from readily available materials and which can be used with existing stringed musical instruments without the need for any expensive or extensive modification of the peghead of the musical instruments. The two-speed tuning machine of my invention can be mounted on a peghead by means well known in the art. Also, as is now customary for other tuning machines, brass gears, plated metal housing components, plastic tuning buttons and the like can be used in the practice of my invention.

Now, having candidly and openly described the presently preferred embodiment of my invention, and having clearly and fully described its manufacture and mode of operation, it will become obvious to those skilled in the art that numerous variations and substitutions in the several elements of my invention can be made following my teaching without departing from the scope of my invention. it would be obvious, therefore, to alter the shape or form of the housing 36 to more closely conform to the gearing contained therein, or, even to eliminate parts of the housing to leave the worm-gear drive partially, or fully, exposed, as is the case with certain existing worm-gear drive tuning machines. Likewise, it would be obvious to relocate worm ring 58 from its present position on the outer circumference or periphery of the exterior of the ring gear 60 to another location, perhaps having a reduced diameter, but still part of the ring gear, although modified. It may be possible, also, as is known to artisans and skilled mechanics, to substitute another equivalent gearing in place of the worm-gear drive used in the present embodiment to selectively rotate ring gear 60 during the second, relatively slow-speed mode of operation of the two-speed tuning machine of my invention.

Despite the simplicity of construction and operation of of the gearing of the presently preferred embodiment of my invention which I have used to illustrate my invention, others may prefer to practice my teaching by developing other, equivalent, arrangements of gearing for the relatively high reduction-ratio gearing. In the precision final tuning mode of operation of my two-speed tuning machine, wherein I have provided the relatively slow rotational motion of the reel post through use of a worm-gear drive which I employ to rotate the entire planetary-gear drive as a unit, I believe that skilled artisans probably can achieve a similar relatively slow rotational motion of the reel post in an alternate system wherein the ring gear is made permanently immobile and a selectively engagable clutch or the like is used to rotationally drive input shaft 76 through an appropriate gear-reduction drive from an independent second input shaft. In such an arrangement, it is obvious that the reel post will be rotated at a relatively high reduction-ratio which is the product obtained by the multiplication of the reduction-ratio of the selectively engagable gearing times the reduction-ratio of the planetary-gear drive. I can even conceive that a sufficiently clever mechanic could have the independent second input shaft aligned concentrically with the axis of input shaft 76. Such a mechanic might use any one of a wide variety of gearing arrangements comprising worm-gearing, planetary-gearing, bevel-gearing, or even other gear-reduction arrangements which in themselves do not have an inherently high reduction-ratio. However, even when gearing with a nominal reduction-ratio is used, because of the multiplying effect resulting from the coupling to the input shaft of the planetary-gear drive, a relatively high reduction-ratio between input and output is provided.

Having described with candor the invention and its manner of use with a presently preferred embodiment as an exemplar, as required by the statute, and realizing full well that innumerable variations can be made in the same without deviation from the teaching of my invention nor departure from the scope thereof, my invention should not be limited to the specific elements incorporated in the disclosed embodiment but should be limited only by the full breadth and extent of the appended claims, wherein I claim:

1. A two-speed tuning machine for a stringed-instrument, comprising:

a first input shaft, a second input shaft, and an output shaft;

first gear means for converting a first angular rotation of said first input shaft into a second angular rotation of said output shaft, said second angular rotation of a reduced angular arc with respect to said first angular rotation; and second gear means for converting a third angular rotation of said second input shaft into a fourth angular rotation of said output shaft, the rate of rotation of said output shaft being a predetermined fraction of the rate of rotation of said second input shaft while maintaining invariant the relative angular rotational relationship of said first input shaft and said output shaft.

2. The tuning machine of claim 1 wherein, said first gear means has a first reduction-ratio and said second gear means has a second reduction-ratio, said second reduction-ratio being relatively high in comparison to said first reduction-ratio.

3. The tuning machine of claim 2 wherein, said first reduction-ratio is no greater than about five and said second reduction-ratio is at least about ten.

4. The tuning machine of claim 3 wherein, said first gear means comprises a planetary-gear train including a sun gear, a plurality of planet gears, and a ring gear.

5. The tuning machine of claim 4 wherein, said first input shaft is fixedly connected to said sun gear to rotate therewith and said output shaft is connected to a support means for mounting said plurality of planet gears in rotational engagement relationship with said sun gear and said ring gear.

6. The tuning machine of claim 5 wherein, said second gear means is coupled to selectively rotate said ring gear.

7. The tuning machine of claim 6 wherein, said second gear means comprises a worm.

8. The tuning machine of claim 7 wherein, said worm engages with a worm ring on the outer periphery of said ring gear.

9. The tuning machine of claim 8 wherein, said machine includes an enclosed housing.

10. A two-speed tuning machine for a musical instrument of the type having a plurality of strings, comprising:

post means for threadably engaging a one of said strings and for reeling said one of said strings thereon during tensioning;

first gear means comprising a planetary-gear train including a sun gear, a plurality of planet gears, and a ring gear, said ring gear including a worm ring on its outer periphery;

support means for mounting said plurality of planet gears in rotationally engaged relationship with said sun gear and said ring gear, said support means fixedly connected to said post means;

first manually-rotational shaft input means for rotating said sun gear;

second manually-rotational shaft input means, including a worm engaged with said worm ring, for rotating said ring gear;

housing means for sealably enclosing said first gear means and said worm; and, means for mounting said tuning machine on a said musical instrument whereby said post means is positioned for engagement with a selected one of said strings.

* * * * *